US005138387A

United States Patent [19]

Sato et al.

[11] Patent Number: 5,138,387

[45] Date of Patent: Aug. 11, 1992

[54] CHARGE INJECTION IMAGE FORMING APPARATUS USING CONDUCTIVE AND INSULATIVE TONE

[75] Inventors: Michiaki Sato, Aichi; Toru Yamamura; Youichiro Goto, both of Gifu; Toru Nose, Gifu, all of Japan

[73] Assignee: Sanyo Electric Co., Ltd., Osaka, Japan

[21] Appl. No.: 775,157

[22] Filed: Oct. 10, 1991

[30] Foreign Application Priority Data

Oct. 12, 1990 [JP] Japan ..... 2-274697
Jun. 17, 1991 [JP] Japan ..... 3-144817

[51] Int. Cl.[5] ..... G03G 15/09

[52] U.S. Cl. ..... 355/251; 118/657; 355/253

[58] Field of Search ..... 346/74.2, 153.1, 160; 355/251, 253, 259, 270, 269, 210, 245; 118/653, 656–658; 430/122, 55, 102

[56] References Cited

U.S. PATENT DOCUMENTS 4,545,669 10/1985 Hays et al. ..... 355/253
4,649,094 3/1987 Tamura et al. ..... 118/657 X
4,666,801 5/1987 Kimura et al. ..... 118/653 X
4,804,994 2/1989 Sasaki et al. ..... 430/122 X
4,950,570 8/1990 Sano et al. ..... 430/55
5,053,821 10/1991 Kunugi et al. ..... 355/251 X

FOREIGN PATENT DOCUMENTS 0033152 3/1978 Japan .
0035546 4/1978 Japan .

*Primary Examiner*—A. T. Grimley
*Assistant Examiner*—William J. Royer
*Attorney, Agent, or Firm*—Darby & Darby

[57] ABSTRACT

An image forming apparatus includes a photoreceptor including a glass substrate and a photoconductive layer laminated thereon. A toner box is provided in the vicinity of the photoreceptor, in which a mixed toner including an insulative non-magnetic toner and a conductive magnetic toner is contained. At an opening of the toner box, a magnetic roller and a developing sleeve which is rotatably put on the magnetic roller are arranged, and a magnetic brush of the mixed toner is formed according to a rotation of the developing sleeve so that the mixed toner is brought into contact with the photoconductive layer. A developing bias having the same polarity as a charged polarity of the insulative non-magnetic toner is applied between the developing sleeve and the photoconductive layer and, at the same time, an exposure light is projected from an LED array on the photoconductive layer through the glass substrate.

4 Claims, 5 Drawing Sheets

CHARGE INJECTION IMAGE FORMING APPARATUS USING CONDUCTIVE AND INSULATIVE TONE

BACKGROUND OF THE INVENTION

1. Field of the Invention

The present invention relates to an image forming apparatus. More specifically, the present invention relates to an image forming apparatus such as an electrophotographic apparatus capable of almost simultaneously carrying out processes such as charging, exposure, development and cleaning without depending on a corona discharge.

2. Description of the Prior Art

As electrophotographic apparatuses generally known include one utilizing a corona discharge. Such an electrophotographic apparatus has a disadvantage of having complicated structure because components for carrying out processes such as a corona discharge, exposure, development, transfer, elimination of charge and cleaning must be arranged around a photoreceptor.

In view of the above described disadvantage, there has been proposed in recent years an electrophotographic apparatus using an electrophotographic process which utilizes no corona discharge, that is, an internal illuminating type or charge injection type electrophotographic process in, for example, an article entitled "Photoreceptor charging mechanism by conductive particle rubbing and application to a novel electrophotographic printing technology", J. Appl. Phys. 63.(11), Jun. 1, 1988.

FIG. 7 is a schematic diagram showing structure of this newly proposed image forming apparatus. The image forming apparatus is constructed by arranging a developing device 12 above a photoreceptor 10 and a transferring device 14 below the photoreceptor 10 as well as arranging an LED array head 16 inside the photoreceptor 10. More specifically, the photoreceptor 10 is constructed by laminating a transparent electrode **10*b* and a photoconductive layer 10*c* which constitutes a photosensitive member on an outer periphery of a cylindrical transparent substrate 10*a* made of a glass. A voltage (V) of approximately 20 volts is applied as a developing bias between the transparent electrode 10*b*, that is, the photoconductive layer 10*c* and a magnetic roller 18 constituting the developing device 12, that is, a developing sleeve 20. A conductive magnetic toner 22 is absorbed on a periphery of the developing sleeve 20 covering an outer periphery of the magnetic roller 18, and a so-called magnetic brush is formed. The magnetic brush faces the outer peripheral surface of the photoconductive layer 10*c*. An electric charge is injected into the photoconductive layer 10*c* from the developing bias through the conductive magnetic toner 22 so that the photoconductive layer 10*c*** is charged to approximately the same potential as the developing bias.

On the other hand, if an exposure light projected from the LED array head 16 is incident on the photoconductive layer **10*c* from an inside of the cylindrical transparent substrate 10*a* to form an electrostatic latent image on the photoconductive layer 10*c*, the toner 22 is adhered on the surface of the photoconductive layer 10*b* from the magnetic brush, and therefore, a toner image is formed. The toner image is transferred onto a recording paper 24 by the transferring device 14. Remaining toners on the surface of the photoreceptor 10 are removed by a cleaning force of the developing device 12 and a magnetic force of the magnetic roller 18. Consequently, processes such as charging, exposure, development and cleaning are almost simultaneously carried out by the developing device 12 and the LED array head 16**, and therefore, structure of an electrophotographic apparatus as well as electrophotographic process can be significantly simplified.

In the above described method where the conductive magnetic toner 22 is utilized, in a case of a direct transferring system, it is required to use a high-resistance recording paper which is obtained by coating a specific material onto a plain paper, and therefore, it is impossible to use a plain paper. In addition, in a case of an indirect transferring system, although a plain paper can be used, a toner image formed on the photoreceptor 10 must be transferred onto a plain paper via an intermediate transferring member such as a transferring belt, and therefore, components such as a cooling device for the transferring belt, a zigzag preventing device for the transferring belt are required. Consequently, an image forming apparatus becomes large and a driving system thereof becomes complex.

As a countermeasure, recently, there is proposed a method where a mixed toner which is obtained by mixing a conductive toner and an insulative toner at a predetermined ratio is used (see Japanese Patent Application Laying-Open Nos. 63-135956 and 63-135970).

In Japanese Patent Application Laying-Open No. 63-135956, there is disclosed a method where a photoreceptor including a photoconductive layer is exposed and, at the same time or just thereafter, a conductive toner charged in a negative polarity is brought into contact with the photoreceptor so that an insulative toner charged in a positive polarity is absorbed to the conductive toner by a local Coulomb force is adhered onto a surface of the photoreceptor, whereby a toner image is formed on the photoreceptor by a mixed toner of the conductive toner and the insulative toner. In addition, in Japanese Patent Application Laying-Open No. 63-135970, there is disclosed a method where a mixed toner of an insulative toner and a conductive toner is used as similar to the above, but each of the toner is a magnetic toner.

However, in the former method, since a charged polarity of the insulative toner and a charged polarity of the photoreceptor which is charge-injected by a developing bias through the conductive toner become opposite to each other, a Coulomb force due to an electrostatic latent image formed by a potential well does not act on the insulative toner. Conversely, the insulative toner is adhered by a developing sleeve, and therefore, an amount of the insulative toners which are adhered onto the photoreceptor becomes extremely small, and consequently, an image density becomes low. In addition, in a case of inverted developing, since a surface potential of a non-image portion and a charged polarity of the insulative toner become opposite to each other, there was a disadvantage that a so-called background fog phenomenon where the insulative toner is adhered on the surface of the non-image portion occurs.

In addition, in the latter method, since the insulative magnetic toner and the conductive magnetic toner are both adhered onto the surface of the developing sleeve, it is difficult to form a smooth electric conductive path toward the photoreceptor. Therefore, a charge which is injected into the photoreceptor through the electric conductive path lacks, and therefore, there was a disadvantage that a background fog phenomenon also occurs.

SUMMARY OF THE INVENTION

Therefore, a principal object of the present invention is to provide a novel charge injection type image forming apparatus.

Another object of the present invention is to provide a charge injection type image forming apparatus in which it is possible to make an image density high.

Another object of the present invention is to provide a charge injection type image forming apparatus in which no background fog occur.

Another object of the present invention is to provide a charge injection type image forming apparatus in which it is possible to adjust an image density.

In an image forming apparatus in accordance with the present invention, a developing agent obtained by mixing an insulative toner and a conductive toner is brought into contact with a surface of a photoreceptor by a developing sleeve so as to form a toner image on the photoreceptor. Characteristically, an insulative non-magnetic toner is used as the insulative toner and a conductive magnetic toner is used as the conductive toner and, in bringing the developing agent which includes the insulative non-magnetic toner and the conductive magnetic toner into contact with the photoreceptor, a bias voltage having the same polarity as a charged polarity of the insulative non-magnetic toner is applied between the developing sleeve and the photoreceptor.

By applying the bias voltage having the same polarity as that of the insulative non-magnetic toner between the photoreceptor and the developing sleeve, the insulative non-magnetic toner is moved toward the photoreceptor and adhered to a low potential portion due to a potential well which forms an electrostatic latent image on the surface of the photoreceptor by a Coulomb force which acts between the low potential portion and the insulative non-magnetic toner and a local Coulomb force which acts between the insulative non-magnetic toner and the conductive magnetic toner.

In accordance with the present invention, since it is possible to move the insulative non-magnetic toner toward the surface of the photoreceptor with a low voltage by the local Coulomb force between the insulative non-magnetic toner and the conductive magnetic toner and the Coulomb force between the insulative non-magnetic toner and the potential well of the surface of the photoreceptor, a toner image mainly composed of the insulative non-magnetic toner can be formed on the surface of the photoreceptor. Therefore, as a recording paper, a plain paper can be used.

In another aspect of the present invention, by changing the rotation number of a developing sleeve, an image density can be adjusted. More specifically, if the rotation number of the developing sleeve is made large, on the assumption that a peripheral speed of the photoreceptor is constant, an amount of toners passing an exposed portion of the photoreceptor within a predetermined time period becomes large, and therefore, a larger amount of toners are adhered on the photoreceptor, and consequently, the image density becomes high. In contrast, if the rotation number is lowered, an amount of toners which are adhered onto the photoreceptor becomes small, and therefore, the image density is lowered. Therefore, if the rotation number of the developing sleeve is controlled in accordance with a density that is set or commanded by a density setting key, for example, by means of a microcomputer, for example, it is possible to adjust the image density with no background fog phenomenon.

The objects and other objects, features, aspects and advantages of the present invention will become more apparent from the following detailed description of the embodiments of the present invention when taken in conjunction with accompanying drawings.

DETAILED DESCRIPTION OF THE PREFERRED EMBODIMENTS

Figure 7:
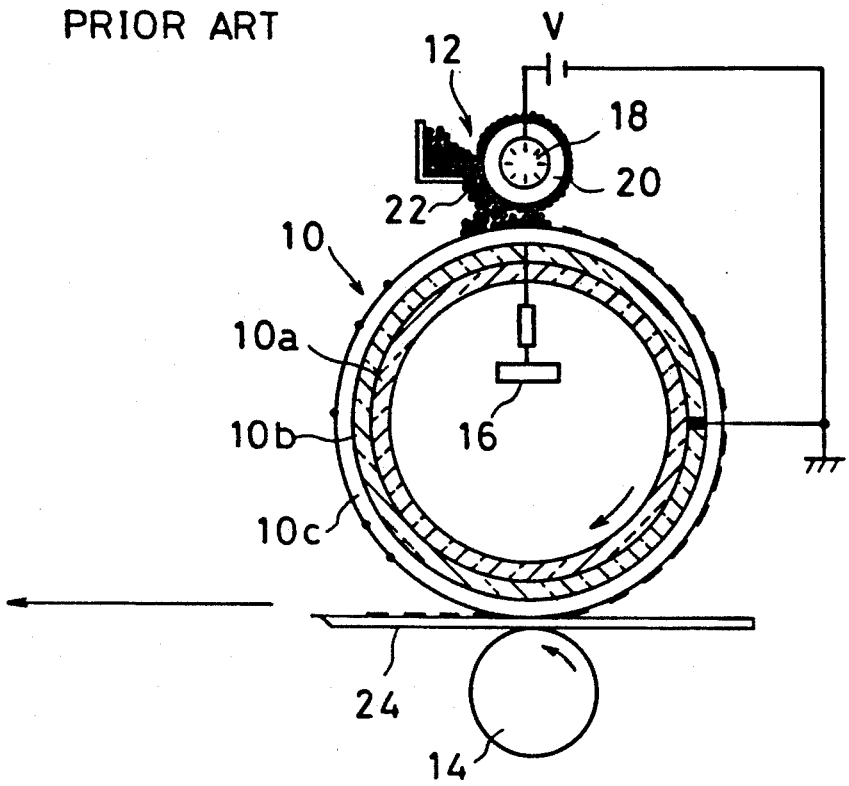
FIG. 7 PRIOR ART
FIG. 7 is an illustrative view showing a major portion of a charge injection type electrophotographic apparatus which becomes a background of the present invention.
Figure 1:
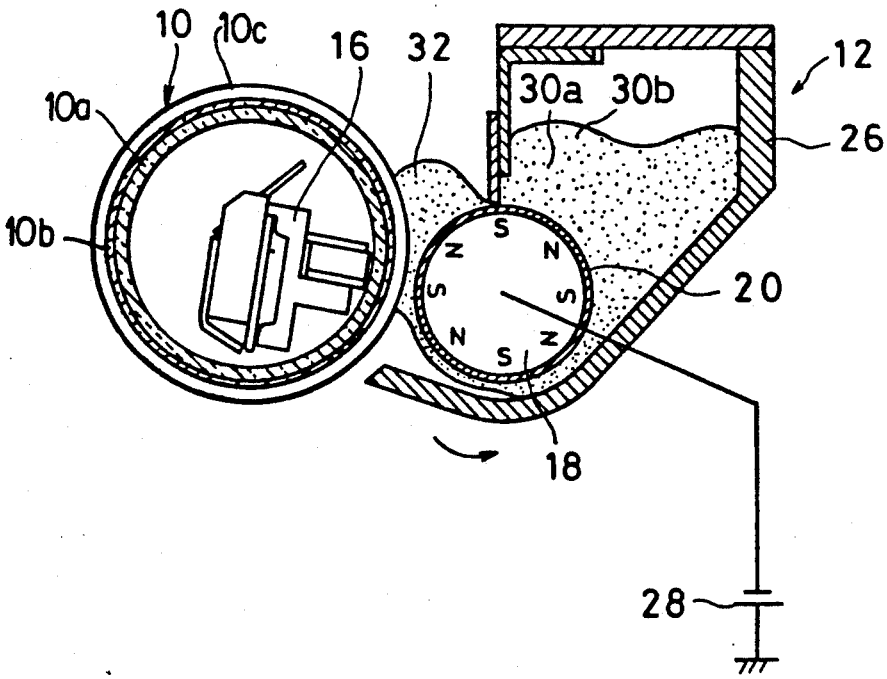
FIG. 1 is an illustrative view showing a relationship between a photoreceptor and a developing device in one embodiment in accordance with the present invention.
Figure 2:
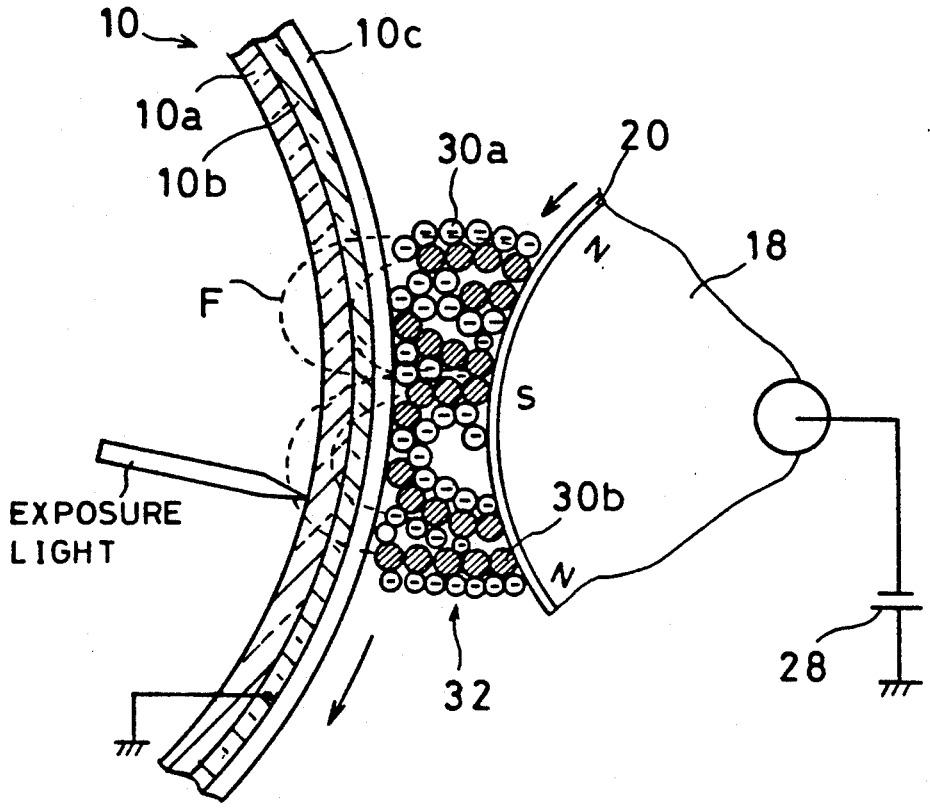
FIG. 2 is a partially enlarged illustrative view showing a manner in which a toner is moved from a developing sleeve to the photoreceptor.

FIG. 1 is an illustrative view showing a relationship between a developing device and a photoreceptor in an image forming apparatus in accordance with the present invention. As similar to FIG. 7 prior art, a photoreceptor 10 is constructed by laminating a transparent electrode **10*b* and a photoconductive layer 10*c* of predetermined thickness on an outer periphery of a transparent cylindrical member 10*a* as shown in FIG. 2. On the other hand, a developing device 12 includes a toner box 26, and in an opening at a lower end of the toner box 26, a magnetic roller 18 having S poles and N poles which are alternately formed on an outer peripheral surface thereof is arranged, and a developing sleeve 20 is put on the outer periphery of the magnetic roller 18 in a rotatable manner. A bias voltage having a negative polarity, for example, is applied to the developing sleeve 20 by a bias voltage source 28**.

A developing agent is stored within the toner box 26 in a state where insulative non-magnetic toners **30*a* and conductive magnetic toners 30*b* are mixed. The insulative non-magnetic toner 30*a* is charged at a negative polarity, for example. Therefore, if the developing sleeve 20 is rotated in a state where the negative bias voltage is applied thereto, as shown in FIG. 2, the conductive magnetic toner 30*b* which is magnetically absorbed by the S polarities and the N polarities of the magnetic roller 18 is moved according to the rotation of the developing sleeve 20. In addition, the insulative non-magnetic toner 30*a* which is coupled to the conductive magnetic toner 30*b* by a local Coulomb force is similarly withdrawn from the toner box 26 by the developing sleeve 20, and therefore, the insulative non-magnetic toner 30a is moved toward a side opposing to a surface of the photoreceptor 10. More specifically, along magnetic force lines F between the N polarities and the S polarities which are alternately formed on the peripheral surface of the magnetic roller 18 in a peripheral direction, a magnetic brush 32 is formed by the conductive magnetic toner 30b and the insulative non-magnetic toner 30a which is adhered or coupled to the conductive magnetic toner 30b** by the local Coulomb force generated by friction charging.

In the magnetic brush 32, an electric conductive path, that is, a chain of toners which are indicated by slanting lines in FIG. 2 is formed by the conductive magnetic toner 30b. Therefore, during when the magnetic brush 32 is brought into contact with the surface of the photoreceptor 10, the surface of the photoreceptor 10 is charge-injected by the developing bias source 28 through the electric conductive path until the surface becomes the same potential as that of the developing bias voltage. Accordingly, the surface of the photoreceptor 10 and the developing sleeve 20 become the same potential and the same polarity, and therefore, a Coulomb force acting on the conductive magnetic toner 30b becomes zero. Consequently, in that state, no electric force which adheres the conductive magnetic toner 30b onto the photoreceptor 10 exist. On the other hand, since a strong local Coulomb force acts between the insulative non-magnetic toner 30a and the conductive magnetic toner 30b, similarly, a force which moves the insulative non-magnetic toner 30a toward the photoreceptor 10 also becomes zero. In addition, since the charged polarity of the photoreceptor 10 and the charged polarity of the insulative non-magnetic toner 30a are the same, a force repelling the insulative non-magnetic toner 30a from the surface of the photoreceptor 10 acts on the both.

Figure 3:
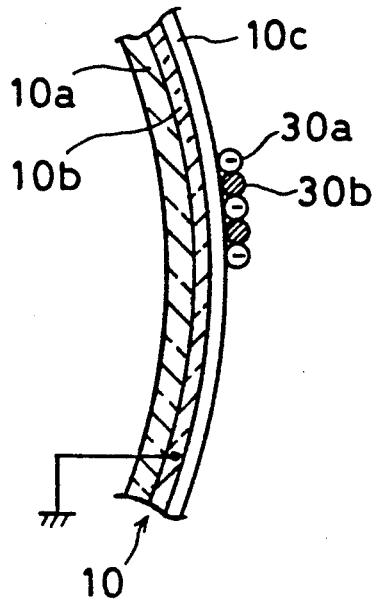
FIG. 3 is an illustrative view showing a toner image formed on the photoreceptor.

In such a charged state of the photoreceptor 10, when an exposure is performed by using the LED array head 16 (FIG. 1) from an inside of the photoreceptor 10, a surface potential of the photoreceptor 10 becomes zero only at an exposed portion, and therefore, an electrostatic latent image is formed by a potential well is formed. Consequently, a relationship that the Coulomb force acting on the conductive magnetic toner 30b is zero is destroyed, and a small Coulomb force due to a transitionally charge injection acts on a portion of the photoreceptor 10 to which the conductive magnetic toner 30b is close, and therefore, the conductive magnetic toner 30b is moved toward the electrostatic latent image on the photoreceptor 10 with the low potential. At the same time, the insulative non-magnetic toner 30a is also moved toward the electrostatic latent image by the local Coulomb force between the same and the conductive magnetic toner 30b, and therefore, the electrostatic latent image formed on the photoreceptor 10 is developed. FIG. 3 shows this state. As well seen from FIG. 3, the conductive magnetic toner 30b is electrostatically adhered to the low potential portion due to the potential well forming the electrostatic latent image on the surface of the photoreceptor 10, and the insulative non-magnetic toner 30a are electrostatically absorbed by the conductive magnetic toner 30b, thereby to form the toner image.

When the toner image is transferred, at first, a charge of a positive polarity, for example, opposite to the charged polarity of the insulative non-magnetic toner 30b is applied to a recording paper 24 by means of a corona discharge, transferring roller or the like, and the recording paper 24 is fed beneath the photoreceptor 10, whereby the insulated non-magnetic toner 30a on the photoreceptor 10 can be transferred on a surface of the recording paper 24 with priority to the conductive magnetic toner 30b. However, the toner image partially includes the conductive magnetic toner 30b which transferred by the small Coulomb force due to the transitional charge injection and the local Coulomb force between the conductive magnetic toner 30b and the insulative non-magnetic toner 30a.

Figure 4A:
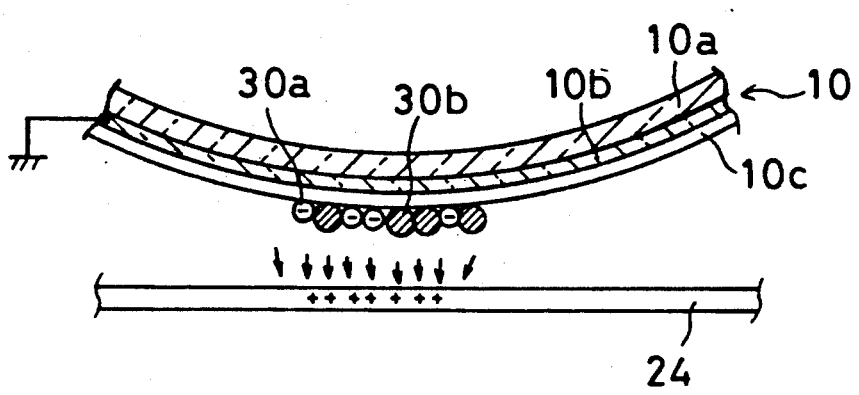
FIGS. 4A and 4B are illustrative views showing a transferring manner of the toner image from the photoreceptor to a recording paper.
Figure 4B:
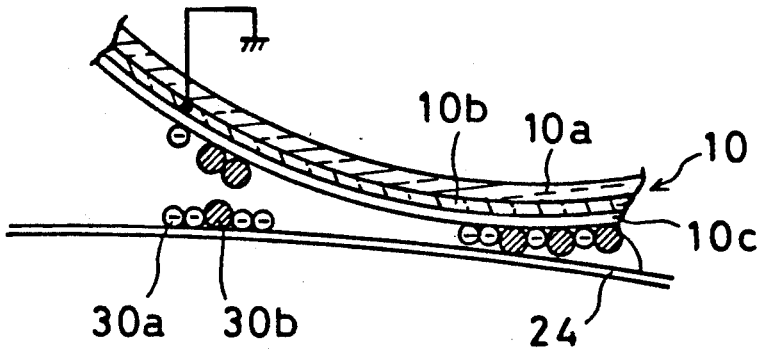

As shown in FIG. 4B, the insulative non-magnetic toner 30a and the conductive magnetic toner 30b are respectively adhered on the surfaces of the recording paper 24 and the photoreceptor 10; however, on the surface of the recording paper 24, a ratio of the insulative non-magnetic toner 30a is larger than a ratio of the conductive magnetic toner 30b. That is, only a small amount of the conductive magnetic toners 30b are partially adhered on the recording paper 24. Therefore, if a suitable fixing performance is applied to the conductive magnetic toner 30b, the conductive magnetic toner 30b and the insulative non-magnetic toner 30a are combined with each other in fixing the toner image transferred on the recording paper 24, and therefore, a possibility of no good fixing of the conductive magnetic toner 30b is reduced. After the fixing, an image which is apparently formed by the insulative non-magnetic toner 30a is formed.

In addition, after completion of the transferring process, the insulative non-magnetic toner 30a and the conductive magnetic toner 30b which are not transferred to the recording paper 24 remain on the surface of the photoreceptor 10. Such remaining toners are retracted toward the developing sleeve 20 by the magnetic absorption force of the magnetic brush 32 and a force due to a residual charge of the insulative non-magnet toner 30 itself during when the magnetic brush 32 (FIG. 1 or FIG. 2) is subsequently brought into contact with the photoreceptor 10. Therefore, the remaining toner can be effectively used again as the developing agent.

Furthermore, the potential well of the electrostatic latent image is made even by a charge injection from the conductive magnetic toner 30b during when the surface of the photoreceptor 10 passes the magnetic brush 32, and resultingly, an adhesion force of the remaining insulative non-magnetic toner 30a and the conductive magnetic toner 30b to the photoreceptor 10 becomes weak, whereby, restoration of the developing agent to the toner box 26 can be accelerated.

In an experiment, the inventors et al. used a developing agent as follows:

a conductive magnetic toner A;
- volume resistivity: $3.4\times10^{2}\ \Omega$ cm
- average particle diameter: 9.15 $\mu$m an insulative non-magnetic toner B;
- volume resistivity: $10^{14}\ \Omega$ cm
- charged polarity: $-30\ \mu c/g$
- average particle diameter: 11 $\mu$m mixing weight ratio: A:B=3:7

By using the above described developing agent, by means of the developing device 12 as shown in FIG. 1, the developing process is performed at conditions that the magnetic roller 18 is fixed, that a ratio of a peripheral speed of the developing sleeve 20 and a peripheral speed of the photoreceptor 10 is set as 1:1-20, and that the developing bias voltage is set as −10--500 volts.

Resultingly, an image density of more than 1.2 was obtained.

In addition, through various experiments, it was confirmed that an applicable range of the volume resistivity of the conductive magnetic toner 30b is less than $10^8$ Ω cm, a suitable range thereof is less than $10^6$ Ω cm, and a most suitable range is less than $10^4$ Ω cm. It was confirmed that an applicable range of the average particle diameter of the conductive magnetic toner 30b is 1–100 μm, a suitable range thereof is 1–50 μm, and a most suitable range is 1–20 ∞m. Furthermore, it was also confirmed that it is possible to use an insulative non-magnetic toner 30a having the volume resistivity of more than four (4) times the volume resistivity of the conductive magnetic toner 30b. It was further confirmed that an applicable range of the average particle diameter of the insulative non-magnetic toner 30a is 1–100 μm, a suitable range thereof is 1–50 μm, and a most suitable range is 1–20 μm. Furthermore, it was confirmed that an applicable range of the mixing weight ration A:B is 1:0.05–10, a suitable range there is 1:0.1–5, and a most suitable range is 1:0.1–3.

In addition, in such a kind of an image forming apparatus, conventionally, an adjustment of an image density is performed by changing the developing bias. However, in a case where a charged polarity of the insulative non-magnetic toner is opposite to the developing bias as shown in Japanese Patent Laying-Open No. 63-135956 which is previously recited, since an absorption force acts on the both, a Coulomb force between the developing bias and the insulative non-magnetic toner becomes strong, and therefore, the insulative non-magnetic toner is adhered on the developing sleeve. The conductive magnetic toner is also adhered on the developing sleeve due to a magnetic force of the magnetic roller inside the developing sleeve. Therefore, an image density just after the developing becomes extremely low. In addition, an experiment was performed by the inventors et al. by utilizing an insulative magnetic toner and a conductive magnetic toner as proposed in Japanese Patent Application Laying-Open No. 63-135970 which is also previously recited. The image density measured by a Macbeth density meter becomes low at 0.8, and the background fog phenomenon drastically increases.

Therefore, in the charge injection type image forming apparatus, in a case where the image density is adjusted by the developing bias, due to an influence of the background fog phenomenon, it was impossible to properly perform an image forming process. Specifically, the image density is to be made large, the developing bias is made high, and therefore, not only the background fog phenomenon increases but also the photoreceptor is affected by a bad influence.

Figure 5:
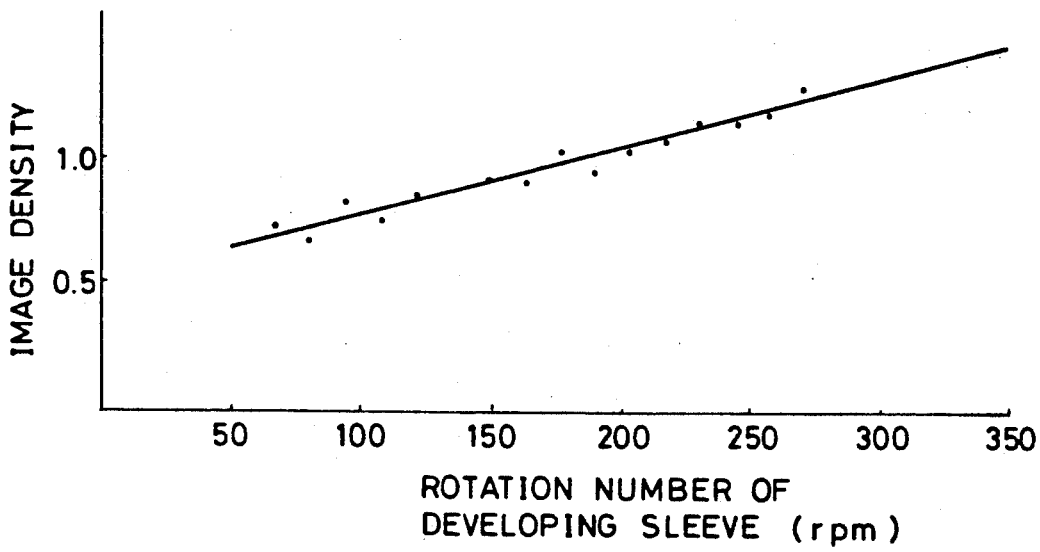
FIG. 5 is a graph showing a relationship between the rotation number of the developing sleeve and an image density.

Therefore, in a preferred embodiment in accordance with the present invention, the image density is adjusted by the rotation number of the developing sleeve 20. As shown in FIG. 5, on the assumption that the peripheral speed of the photoreceptor 10 is constant, the larger rotation number of the developing sleeve 20, the larger image density. When the peripheral speed of the photoreceptor 10 is smaller than the peripheral speed of the developing sleeve 20 and the rotation number of the developing sleeve 20 is large, an amount of the toners passing the exposed portion within a predetermined time period becomes large, and therefore, a larger amount of toners are adhered on the photoreceptor 10.

Figure 6:
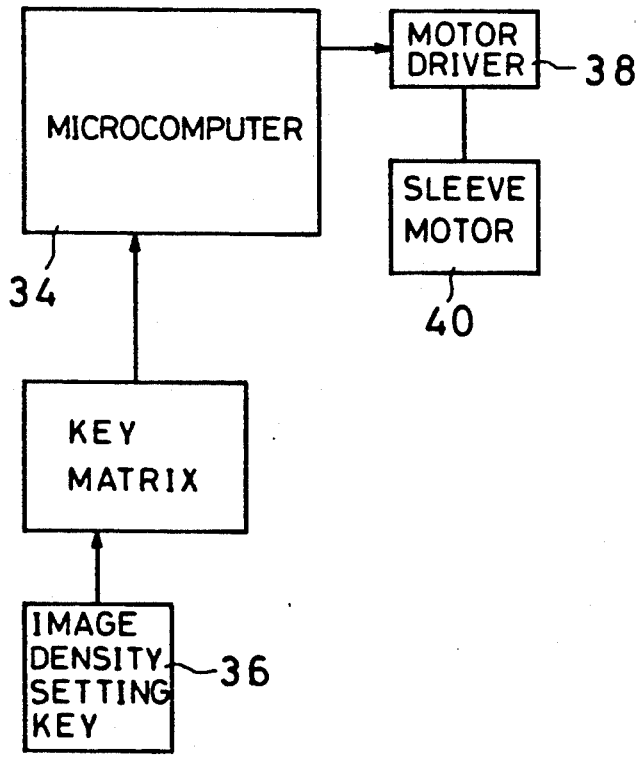
FIG. 6 is a block diagram showing a major portion of one embodiment in accordance with the present invention.

In an embodiment shown in FIG. 6, a microcomputer 34 controls a motor driver 38, that is, a sleeve motor 40 on the basis of an image density set by the image density setting key 36 with reference to FIG. 5. More specifically, when the image density which is set by the image density setting key 36 is large, the microcomputer 34 makes the sleeve motor 40 rotate faster and, when the image density is small, the microcomputer 34 rotates the sleeve motor 40 at a lower speed. However, in a case where a main motor (not shown) is also used as the sleeve motor 40, the microcomputer 34 may control a transfer mechanism (not shown) to change a reduction ratio.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

a photoreceptor including a transparent substrate and a photoconductive layer laminated on said transparent substrate;

storing means provided in the vicinity of a surface of said photoconductive layer of said photoreceptor for storing a developing agent in which an insulative non-magnetic toner and a conductive magnetic toner are mixed;

developing means relatively displaced with respect to said photoreceptor for bringing said developing agent stored in said storing means into contact with said photoreceptor;

exposure means for projecting through said transparent substrate an exposure light to said photoconductive layer at a portion where said developing agent is brought into contact with; and developing bias means for applying a predetermined developing bias of the same polarity as a charged polarity of said insulative non-magnetic toner between said developing means and said photoconductive layer.

2. An image forming apparatus in accordance with claim 1, wherein said developing means includes a magnetic roller and a developing sleeve rotatably put on said magnetic roller.

3. An image forming apparatus in accordance with claim 2, further comprising image density setting means; and controlling means for controlling the rotation number of said developing sleeve in accordance with an image density set by said image density setting means.

4. An image forming apparatus, comprising:

a photoreceptor including a transparent substrate and a photoconductive layer laminated on said transparent substrate;

storing means provided in the vicinity of a surface of said photoconductive layer of said photoreceptor for storing a developing agent in which an insulative non-magnetic toner and a conductive magnetic toner are mixed;

developing means relatively displaced with respect to said photoreceptor for bringing said developing agent stored in said storing means into contact with said photoreceptor, said developing means including a magnetic roller and a developing sleeve rotatably put on said magnetic roller;

exposure means for projecting through said transparent substrate an exposure light to said photoconductive layer at a portion where said developing agent is brought into contact with;

driving means for driving for rotation said developing sleeve; and controlling means for controlling said driving means so as to control the rotation number of said developing sleeve.

* * * * *